US010389048B1

(12) United States Patent
Wu

(10) Patent No.: US 10,389,048 B1
(45) Date of Patent: Aug. 20, 2019

(54) TERMINAL BLOCK HAVING FASTENING HANDLE

(71) Applicants: DINKLE ENTERPRISE CO., LTD., New Taipei (TW); DINKLE ELECTRIC MACHINERY (CHINA) CO., LTD., Kunshan, Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Kunshan, Jiangsu (CN)

( * ) Notice: Subject to any disclaimer, the term of this patent is extended or adjusted under 35 U.S.C. 154(b) by 0 days.

(21) Appl. No.: 16/365,575

(22) Filed: Mar. 26, 2019

Related U.S. Application Data

(62) Division of application No. 15/914,845, filed on Mar. 7, 2018.

(51) Int. Cl.

| | |
|---|---|
| ***H01R 4/36*** | (2006.01) |
| ***H01R 9/24*** | (2006.01) |
| ***H01R 12/71*** | (2011.01) |
| ***H01R 12/51*** | (2011.01) |

(52) U.S. Cl.
CPC ..... *H01R 9/2416* (2013.01); *H01R 12/515* (2013.01); *H01R 12/718* (2013.01)

(58) Field of Classification Search
CPC ..... H01R 13/6271; H01R 13/6272; H01R 13/6275; H01R 13/6278; H01R 4/38
USPC ..... 439/810, 811, 815, 354, 358, 727
See application file for complete search history.

(56) References Cited

U.S. PATENT DOCUMENTS

| | | | | |
|---|---|---|---|---|
| 5,743,755 | A * | 4/1998 | Aoki | H01R 13/6272 439/310 |
| 9,397,444 | B1 * | 7/2016 | Wu | H01R 4/4845 |
| 9,466,897 | B1 * | 10/2016 | Wu | H01R 9/2491 |
| 9,954,306 | B2 * | 4/2018 | Taguchi | H01R 12/75 |

* cited by examiner

*Primary Examiner* — Hien D Vu
(74) *Attorney, Agent, or Firm* — Chun-Ming Shih; HDLS IPR Services

(57) ABSTRACT

A terminal block includes a first connection member, a second connection member and a fastening handle. The first connection member includes a handle platform, a protruding plate protruding from the handle platform, and a cavity inside the handle platform. A retaining slot communicating with the cavity is formed inside the protruding plate. The second connection member includes a fastening slot into which the protruding plate is plugged and includes a fastening portion arranged near the fastening slot. The fastening handle includes an end section inserted through the retaining slot and engaged with the protruding plate, an engagement section extended from the end section and received in the cavity, and a head section protruding out of the handle platform.

14 Claims, 10 Drawing Sheets

TERMINAL BLOCK HAVING FASTENING HANDLE

CROSS-REFERENCE TO RELATED APPLICATION

This application is a divisional application of U.S. patent application Ser. No. 15/914,845, filed on Mar. 7, 2018. The entire disclosures of the above application are all incorporated herein by reference.

TECHNICAL FIELD

The present invention relates to a terminal block and, in particular, to a pluggable-type terminal block having a fastening handle.

BACKGROUND

A terminal block can be considered as one type of electrical connectors. By using the terminal block, connection between wires, between wires and circuit boards, or between circuit boards can be established. Therefore, the terminal block is one of the essential parts in electronic equipment. As the terminal base is used more and more extensively, it has various structures to be adapted to different objects, frequencies, environments, and etc.

A pluggable-type terminal block for connecting wires and a circuit board is provided in the market. It allows quick installation and easy maintenance, and saves space. Such terminal blocks typically include a plug, a wire covering terminal on the plug, a socket for insertion of the plug, and a conductive terminal inserted in the socket. The plug has a wiring hole for connecting a wire, the wiring hole is connected to the conductive terminal for connecting the wire. However, the plug and the socket are only engaged by their structure configuration, so the connection therebetween tends to become loose due to vibrations of equipment or displacement of the wires, which even leads to detachment to jeopardize the stability in signal transmission or power delivery.

In view of this, the inventor studied various technologies and created an effective solution in the present disclosure.

SUMMARY

It is an objective of the present invention to provide a terminal block having a fastening handle in the middle, so as to facilitate a compact configuration.

It is another objective of the present invention to provide a terminal block having a fastening handle, whereby automatic fastening with a secure fastening effect can be achieved upon insertion.

It is still another objective of the present invention to provide a terminal block having a fastening handle, whereby detachment/removal can be achieved without the use of any hand tools.

It is yet still another objective of the present invention to provide a fastening handle with a reduced weight and enhanced structural strength.

Accordingly, the terminal block having a fastening handle is provided in this disclosure. The terminal block includes a first connection member, a second connection member and a fastening handle. The first connection member includes a plurality of wiring bases arranged in a spaced relationship to each other, a handle platform adjoining any of the wring bases, a protruding plate protruding from the handle platform, and a cavity inside the handle platform. A retaining slot communicating with the cavity is formed inside the protruding plate. Each wring base is correspondingly assembled to the second connection member. The second connection member includes a fastening slot into which the protruding plate is plugged and includes a fastening portion disposed adjacent to the fastening slot. The fastening handle includes an end section inserted in the retaining slot and engaged with the protruding plate, an engagement section extended from the end section and received in the cavity, and a head section protruding out of the handle platform. When the head section is moved toward the cavity, the engagement section is released from the fastening portion and is detached from the second connection member.

In one embodiment, the first connection member further includes a first through hole below the cavity and includes a partition plate separating the cavity from the through hole. The second connection member further includes a second through hole disposed corresponding to the first through hole and includes a screw connection element perpendicularly inserted through the second through hole. The cover includes a third through hole disposed corresponding to the first through hole. A second fastening element, like a screw rod, is inserted through the third through hole, the first through hole and the second through hole to be fastened to the screw connection element, so that the first connection member and the second connection member are securely fastened to each other. The second fastening element can be used as needed to obtain a more secure fastening connection between the first connection member and the second connection member.

According to one embodiment of the present invention, a fastening handle is mounted in the terminal block. The fastening handle includes an end section, an engagement section and a head section. The end section has a flat shape, and a first protruding block is disposed on one side of the end section. The engagement section is extended from one end of the end section, a second protruding block is disposed on one side of the engagement block, and the second protruding block and the first protruding block are disposed on different sides. The head section is coupled to one end of the engagement section in a manner such that the head section is inclined with respect to the engagement section to form an angle therebetween.

According to one embodiment of the present invention, the fastening handle is disposed in the middle of the terminal block, so that only one fastening handle is required. Unlike conventional fastening handles which are typically arranged in the periphery, the fastening handle of the present invention can be arranged in the center of the terminal block or in other position near the center, thus eliminating the need of a second fastening handle and thereby saving production costs. Accordingly, a compact configuration can be realized without reducing functionality. More powerful functionality can even be obtained with the same structure and configuration layout. The present invention allows easy and convenient operation, and only one hand is required to operate the fastening handle.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Figure 1:
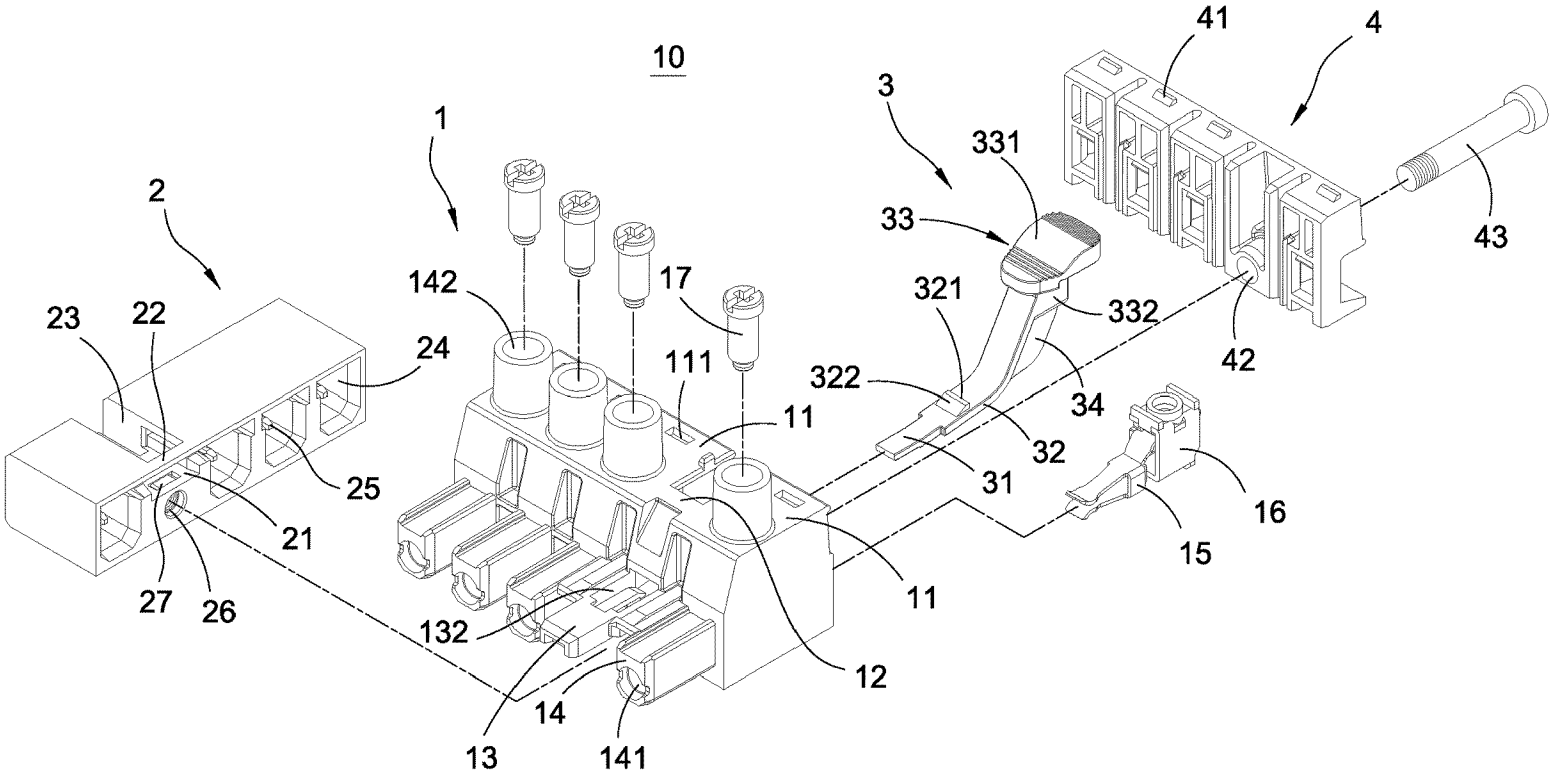
FIG. 1 is an exploded view illustrating a terminal block having a fastening handle according to the present invention.

Detailed descriptions and technical contents of the present disclosure are illustrated below in conjunction with the accompanying drawings. However, it is to be understood that the descriptions and the accompanying drawings disclosed herein are merely illustrative and exemplary and not intended to limit the scope of the present disclosure.

Referring to FIGS. 1 to 6, the present invention provides a terminal block 10 having a fastening handle. The terminal block 10 includes a first connection member 1, a second connection member 2, and a fastening handle 3. The terminal block 10 can be, but not limited to, a pluggable-type terminal block. The second connection member 2 is preferably electrically connected to a circuit board (not illustrated). The first connection member 1 coupled to a wire 5 is plugged in the second connection member 2 to enable signal transmission and/or electric power delivery. The first connection member 1, the second connection member 2 and the fastening handle 3 are preferably formed from an insulating material.

The first connection member 1 includes a plurality of wring bases 11 arranged in a spaced relationship to each other, a handle platform 12 adjoining any of the wring bases 11, a protruding plate 13 protruding from the handle platform 12, and a cavity 121 inside the handle platform 12. A retaining slot 131 communicating with the cavity 121 is formed inside the protruding plate 13. In the embodiment shown in FIGS. 1 to 3, each of the wring bases 11 includes a plug element 14, a wire insertion chamber 141 and a wire fastening chamber 142. The plug element 14 protrudes from the wring base 11 and is parallel to the protruding plate 13, a wire insertion chamber 141 is formed inside the plug element 14, and a wire fastening chamber 142 communicates with the wire insertion chamber 141.

Each of the wring bases 11 includes a wire connection terminal 15, a conductive case 16 and a first fastening element 17. The wire connection terminal 15 is inserted into the wire insertion chamber 141 inside the plug element 14, the conductive case 16 is disposed between the wire insertion chamber 141 and the wire fastening chamber 142, and the first fastening element 17 is inserted in the wire fastening chamber 141 and fastens the conductive case 16 and the wire 5 (a core 51). One end of the wire connection terminal 15 is in contact with one side of the conductive case 16, the core 51 is inserted in the conductive case 16 and in contact with one end of the wire connection terminal 15, and then the first fastening element 17 detachably penetrates the conductive case 16 to fasten the core 51.

Figure 2:
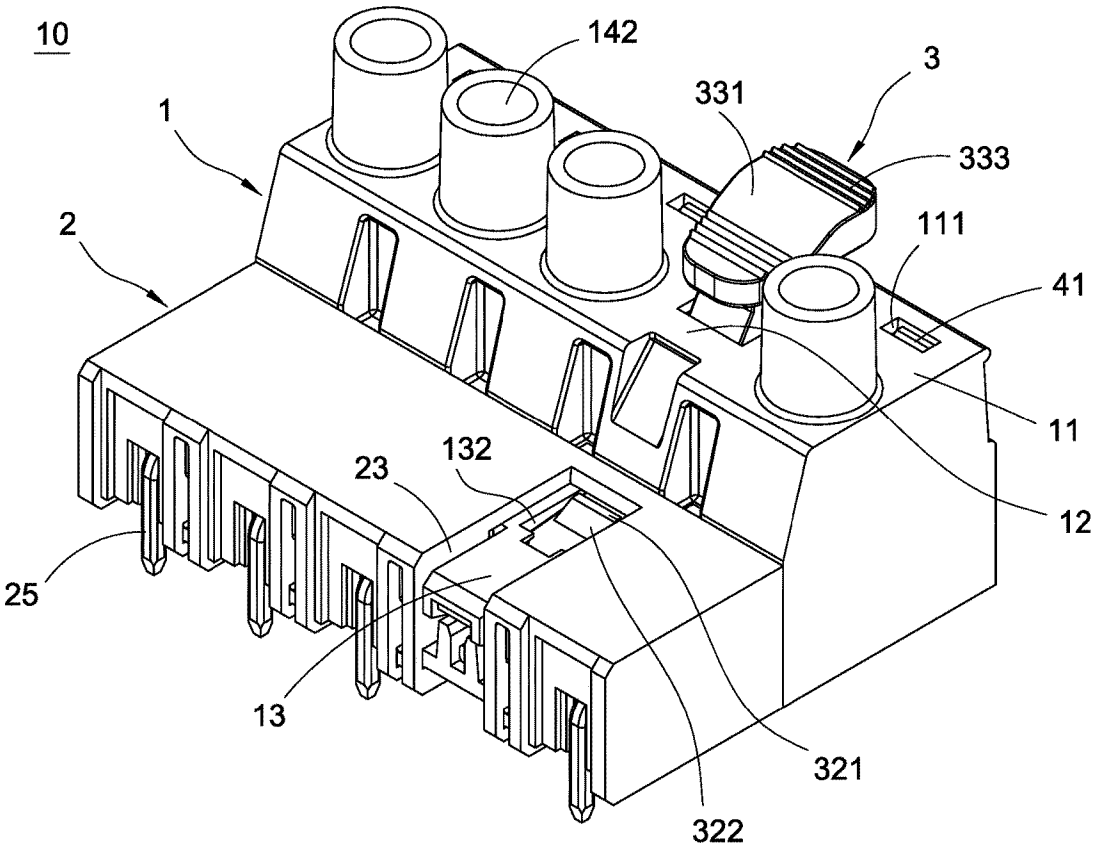
FIG. 2 is an assembled view illustrating the terminal block having the fastening handle.

As shown in FIGS. 1 and 2, the handle platform 12 is preferably disposed between two adjacent wring bases 11 to facilitate a user's holding and operating the fastening handle 3. In alternative embodiments, the handle platform 13 is connected to any of the wring bases 11—at one side, in the middle, or in any other suitable position; the configuration may vary as required.

Figure 3:
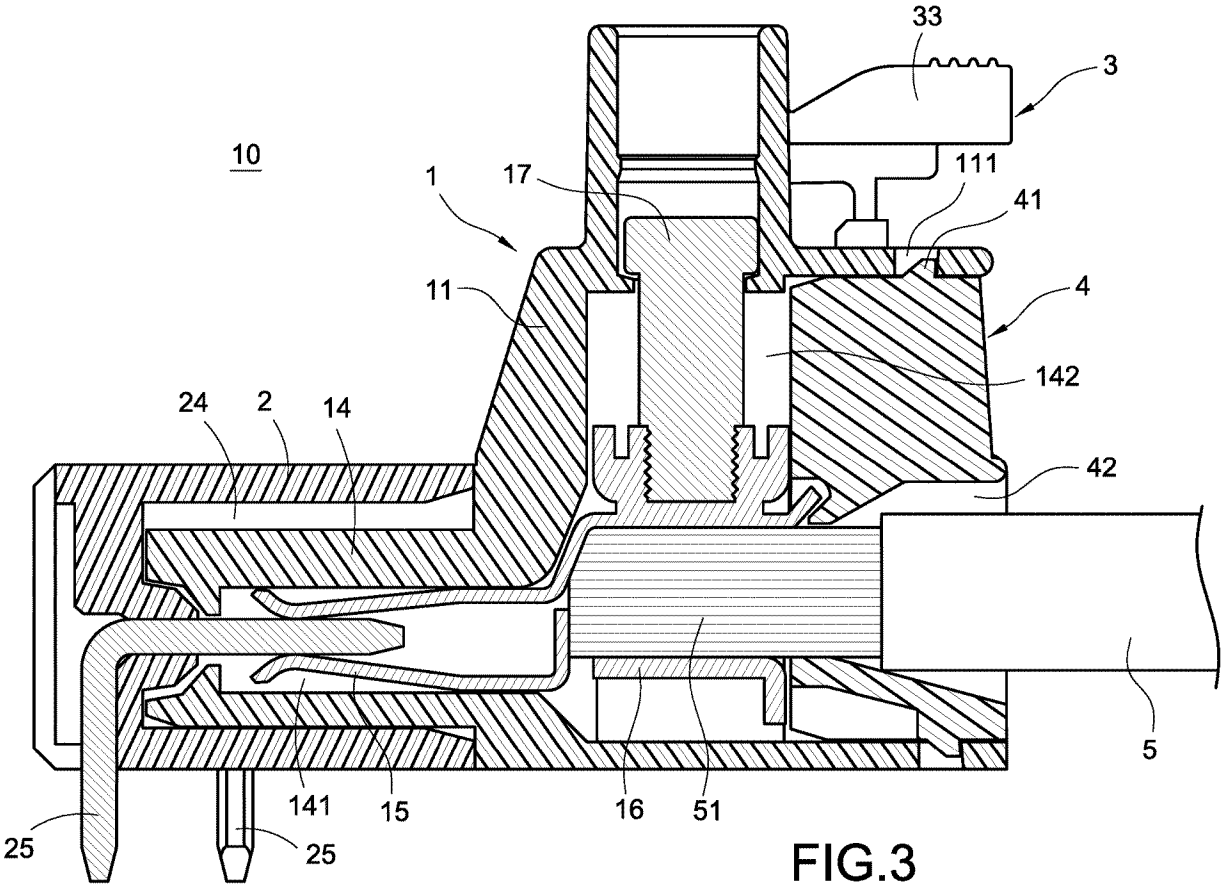
FIG. 3 is a cross-sectional view illustrating the terminal block having the fastening handle.
Figure 4:
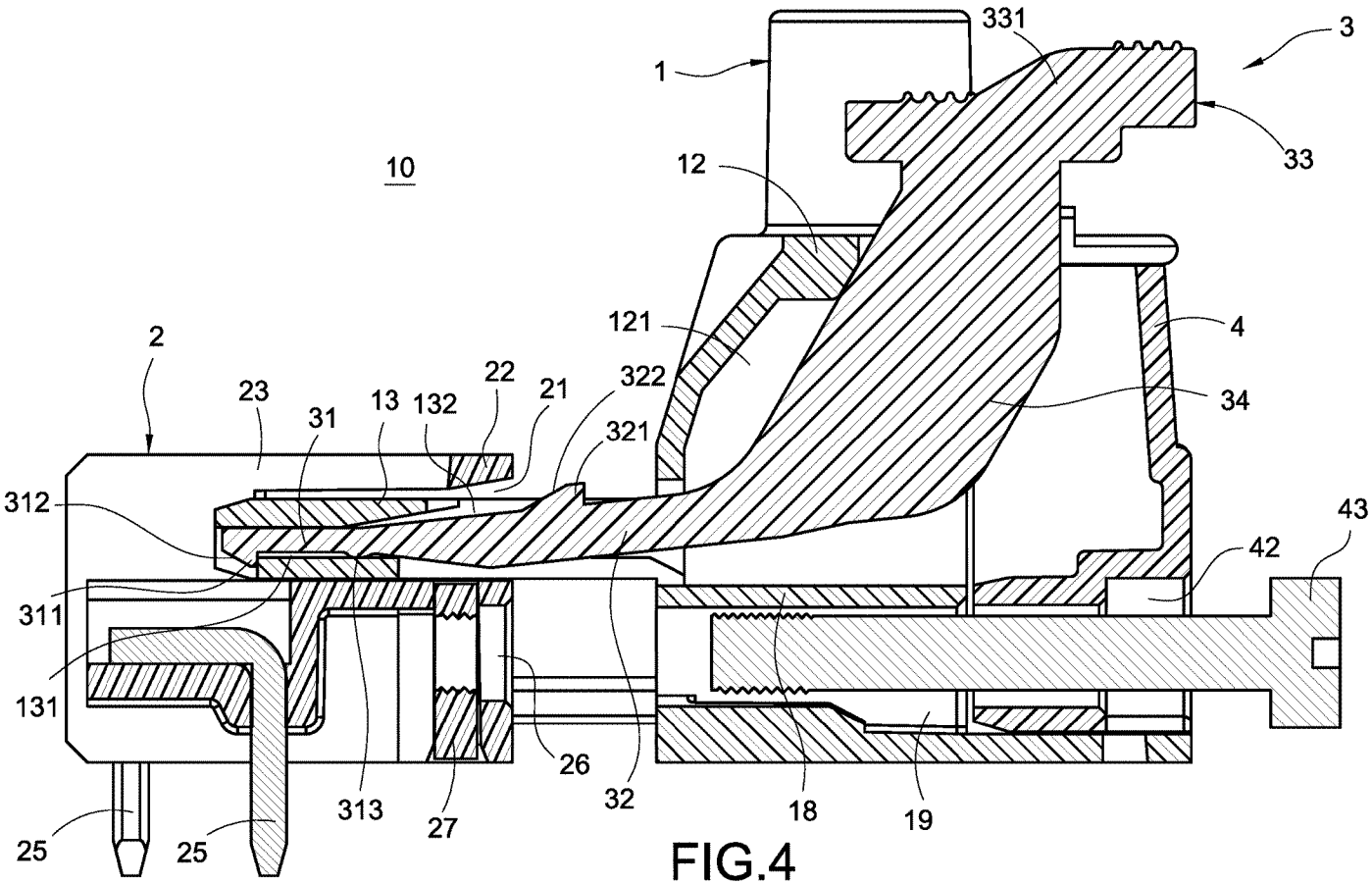
FIG. 4 is a cross-sectional view illustrating the terminal block having the fastening handle before the fastening handle is fastened.

Each of the wring bases 11 is assembled to the second connection member 2. The second connection member 2 includes a fastening slot 21 into which the protruding plate 13 is plugged and includes a fastening portion 22 disposed adjacent to the fastening slot 21. Referring to FIGS. 1 to 3, the second connection member 2 includes a plurality of insertion slots 24 and a plurality of connecting terminals 25 inserted in the insertion slots 24 respectively. Each connecting terminal 25 partially protrudes out of the second connection member 2 to be welded to the circuit board (not illustrated). One end of one of the connecting terminals 25 is connected to the wire connection terminal 15, thereby achieving signal transmission and/or electric power delivery between the wire 5 and the circuit board.

The fastening handle 3 includes an end section 31, an engagement section 32 and a head section 33. The end section 31 is inserted through the retaining slot 131 and engaged with the protruding plate 13, the engagement section 32 is extended from the end section 31 and received in the cavity 121, and the head section 33 protrudes out of the handle platform 12. A width of the end section 31 is smaller than a width of the engagement section 32, so that the end section 31 is secured in the retaining slot 131.

Figure 7:
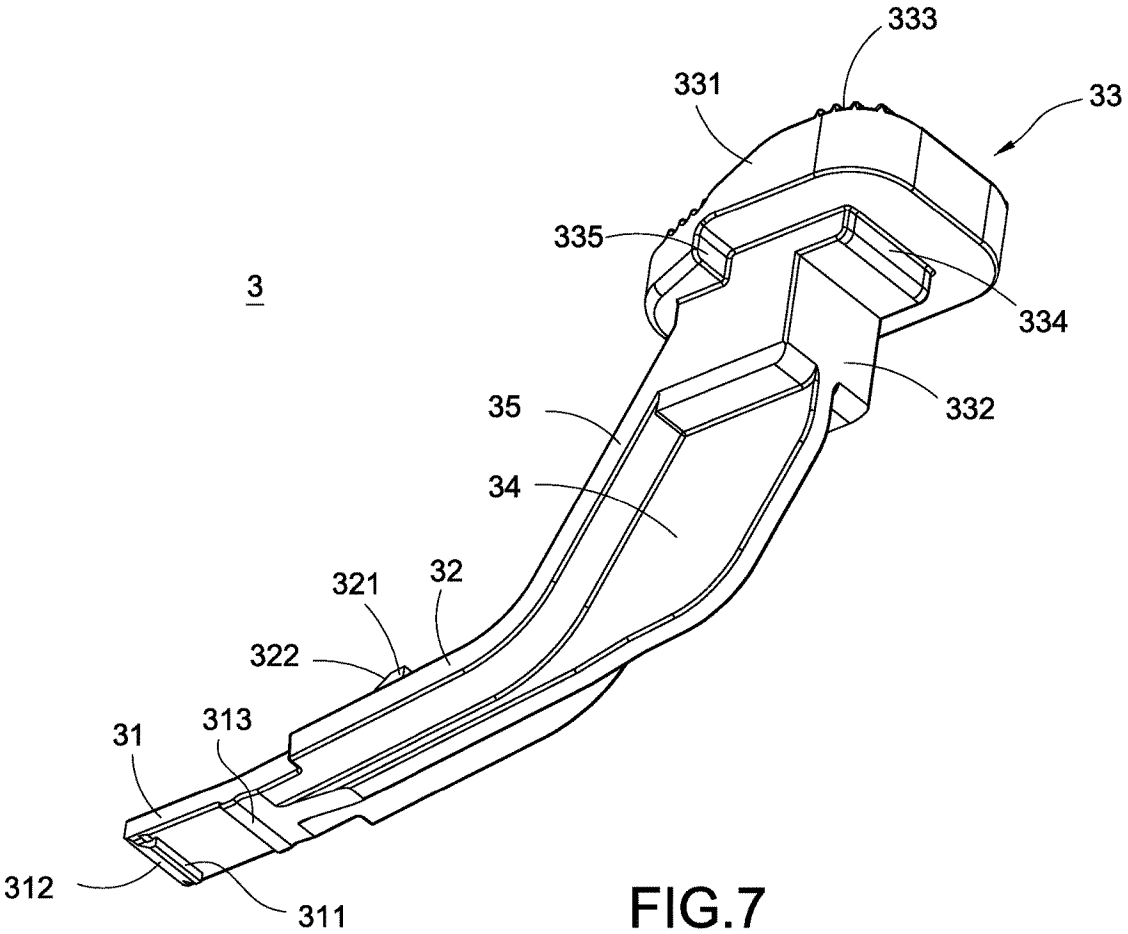
FIG. 7 is a perspective view illustrating the fastening element.
Figure 8:
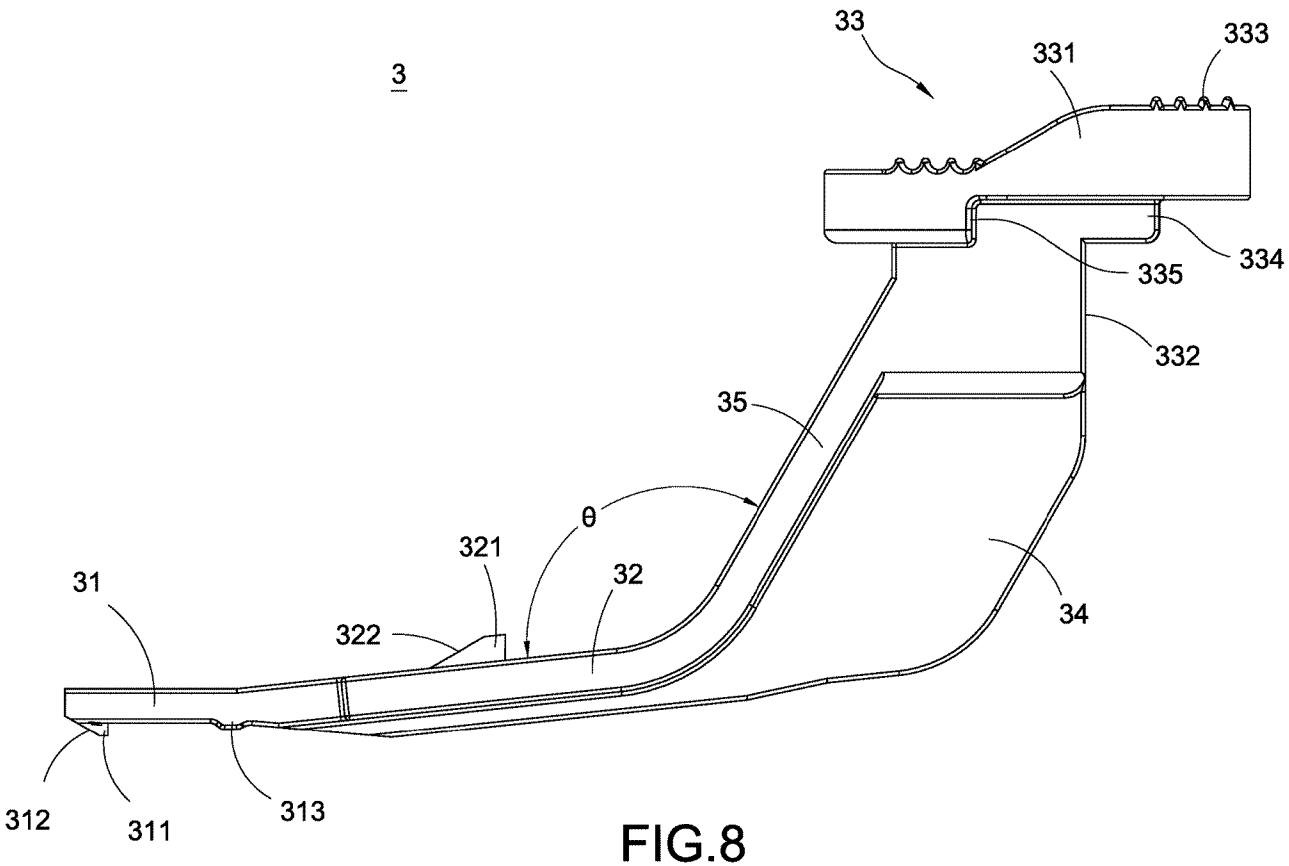
FIG. 8 is a side view illustrating the fastening handle.

Referring to FIGS. 7 and 8, the fastening handle 3 further includes a first protruding block 311 on the end section 31, a second protruding block 321 protruding from one side of the engagement section 32, and a connection rib 34 disposed between the engagement section 32 and head section 33. The first protruding block 311 includes an inclined surface 312 disposed corresponding to an inner surface of the protruding plate 13, and the second protruding block 321 includes an inclined surface 322 disposed corresponding to an upper end surface of the second connection member 2, so that the second protruding block 321 can be slid to pass by the fastening portion 22 and then be engaged with the same.

The end section 31 includes a fulcrum portion 313 abutted against the inner surface of the protruding plate 13, and the fulcrum portion 313 protrudes in a direction the same as a protruding direction of the first protruding block 311, so that the head portion 33 of the fastening handle 3 can be pivoted about the fulcrum portion 313 as a fulcrum pivot point. The fastening handle 3 further includes a bent section 35 and a connection rib 34. The bent section 35 is connected between the head section 33 and the engagement section 32, and the connection rib 34 perpendicularly protrudes from a bottom of the fastening handle 3. The connection rib 34 is extended from the head section 33 to the engagement section 32. The head section 33 includes a pressing portion 331 connected to the bent section 35 and includes a rectangular rib 332 connected under the pressing portion 331, so that the fastening handle 3 is like a J shape.

Figure 9:
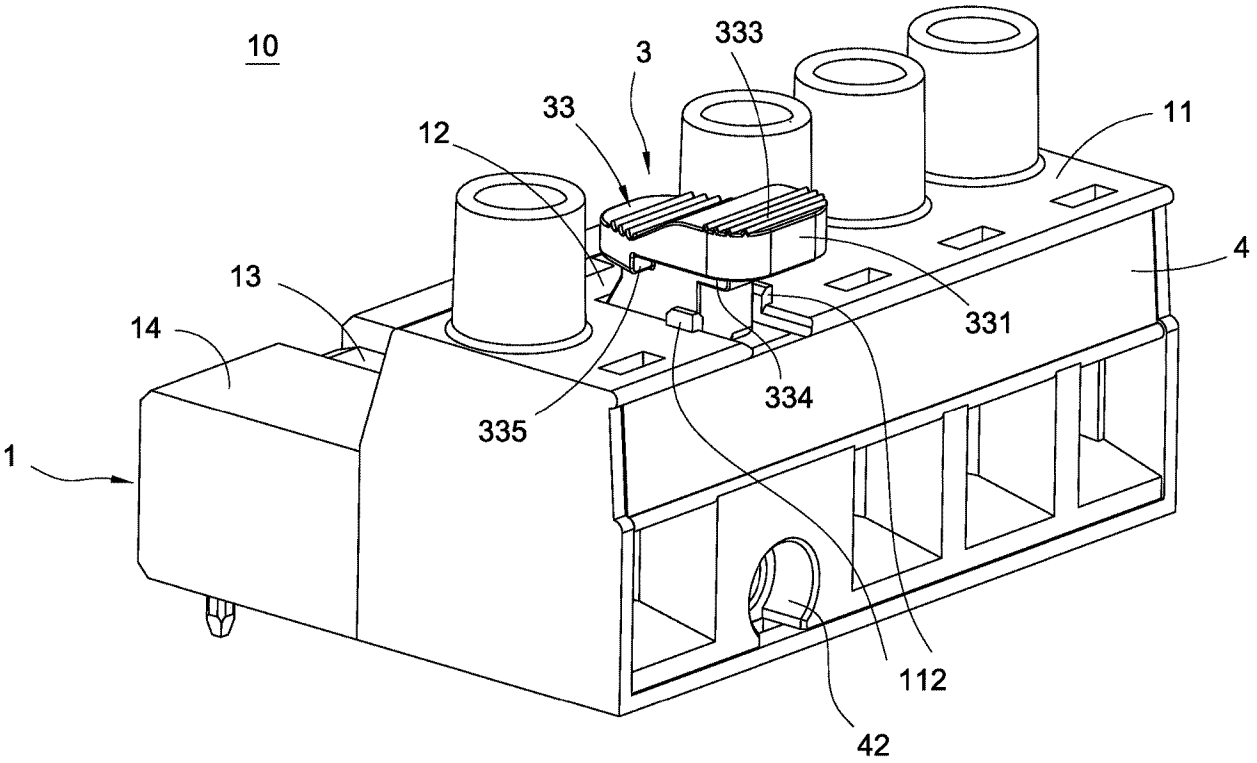
FIG. 9 is a perspective view, viewed from another angle, illustrating the terminal block having the fastening handle.
Figure 10:
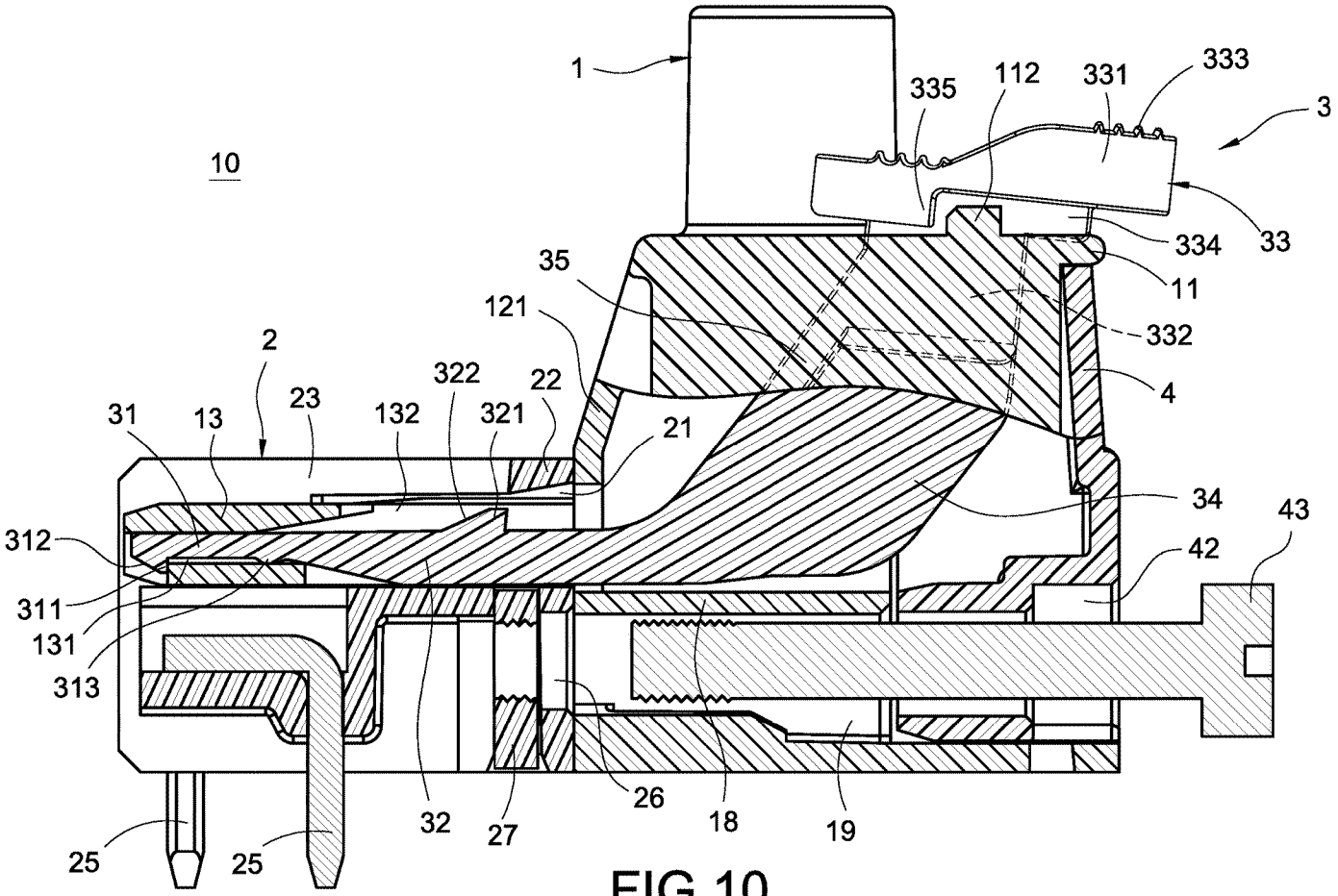
FIG. 10 is a cross-sectional view illustrating that the terminal block having the fastening handle is pressed.

Referring to FIGS. 9 and 10, a plurality of protruding patterns 333 are disposed on a surface of the pressing portion 331 to facilitate press operations of the user. A blocker 334 and two limiting blocks 335 partially connected to the blocker 334 at two sides thereof are extended from one end of the rectangular rib 332 away from the end section 31. The blocker 334 and the two limiting blocks 335 are disposed between the pressing portion 331 and the rectangular rib 332. Two engagement blocks 112 disposed corresponding to the two limiting blocks 335 protrude from the wring base 11. Therefore, when the fastening handle 3 is pressed, the two limiting blocks 335 are abutted against the two engagement blocks 112 of the wiring base 11, and the first connection member 1 can be removed.

When the fastening handle 3 is pressed, the force is concentrated on the first protruding block 311. The first protruding block 311 has a small size and lacks sufficient toughness, which may cause the fastening handle 3 to be accidentally detached from the first connection member 1 when the user presses the fastening handle 3 to pull out the first connection member 1. In order to solve this problem, two engagement blocks 112 are arranged on the wring base 11 to be abutted against the two limiting blocks 335. This configuration prevents the first protruding block 311 from being damaged and prevents the fastening handle 3 from being detached from the first connection member 1, i.e. an overly large displacement of the fastening handle 3 is avoided. Furthermore, the bent section 34 of the fastening handle 3 is connected to the rectangular rib 332 which is hollow inside, so the fastening handle 3 has a reduced weight but a strong structure.

Furthermore, in order to engage the second protruding block 321 with the fastening portion 22, the protruding plate 13 of the first connection member 1 includes a first opening 132 from which the second protruding block 321 protrudes, and the second connection member 2 includes a second opening 23 disposed corresponding to the first opening 132, so that the second protruding block 321 is inserted through the second opening 23 to be engaged with the fastening portion 22.

In the embodiment shown in FIGS. 1 to 6, the terminal block 10 further includes a cover 4 covering the wring bases 11 of first connection member 1, a plurality of the third protruding blocks 41 are arranged in a spaced-apart relationship to each other at one side of the cover 4, and each of the wring bases 11 includes a fastening opening 111 corresponding to a respective corresponding one of the third protruding blocks 41, so that the cover 4 can be assembled to the first connection member 1 easily and conveniently.

When the fastening handle 3, each wire 5 and the cover 4 are assembled to the first connection member 1, the second connection member 2 can be connected to the first connection member 1. The plug elements 14 of the first connection member 1 are plugged into the insertion slots 24 of the second connection member 2, respectively. When the protruding plate 13 is plugged into the fastening slot 21, the second protruding block 321 of the fastening handle 3 passes through the fastening slot 21 to be engaged with the fastening portion 22 for a secure fastening effect.

When it is desired to remove the first connection member 1 from the second connection member 2, a user only needs to press the fastening handle 3 to detach the second protruding block 321 of the engagement section 32 from the fastening portion 22 of the second connection member 2. No hand tools are required to remove the first connection member 1, and it is rapid and easy to remove/detach the first connection member 1 from the second connection member 2. Referring to FIGS. 9 and 10, when the fastening handle 3 is not pressed, the fastening handle 3 is restored to its original position/state due to the structure and the resilient property of the fastening handle 3 itself.

In order to more securely fasten the first connection member 1 to the second connection member 2, the second fastening element 43 is threadedly fastened to the screw connection element 27. In alternative embodiments, to obtain an even more enhanced fastening connection, a screw or a blot can be selectively used to fasten the end section 31 of the fastening handle 3 to the second connection member 2.

Figure 5:
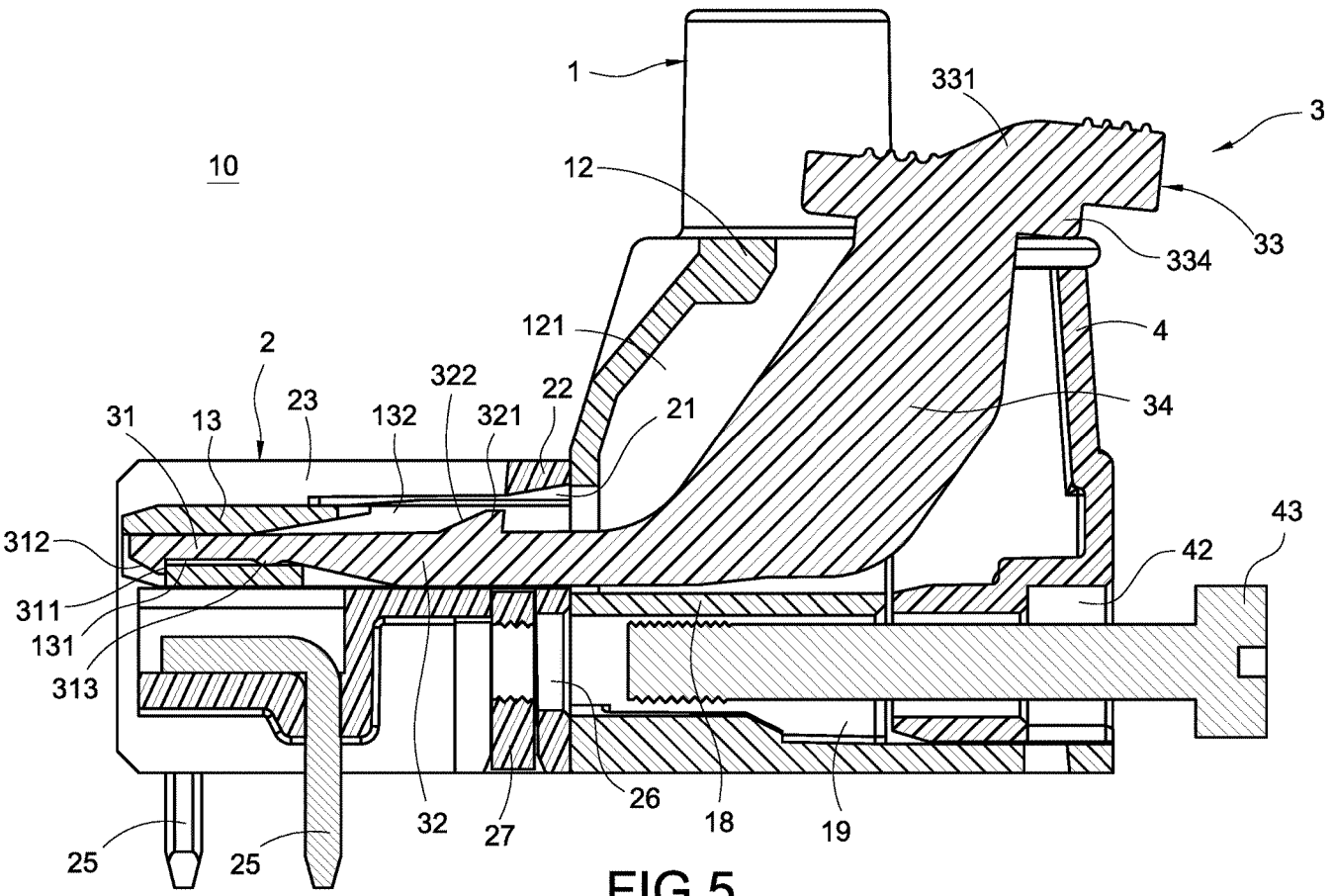
FIG. 5 is a cross-sectional view illustrating the terminal block having the fastening handle after the fastening handle is fastened but before the fastening handle is restored to its original position.
Figure 6:
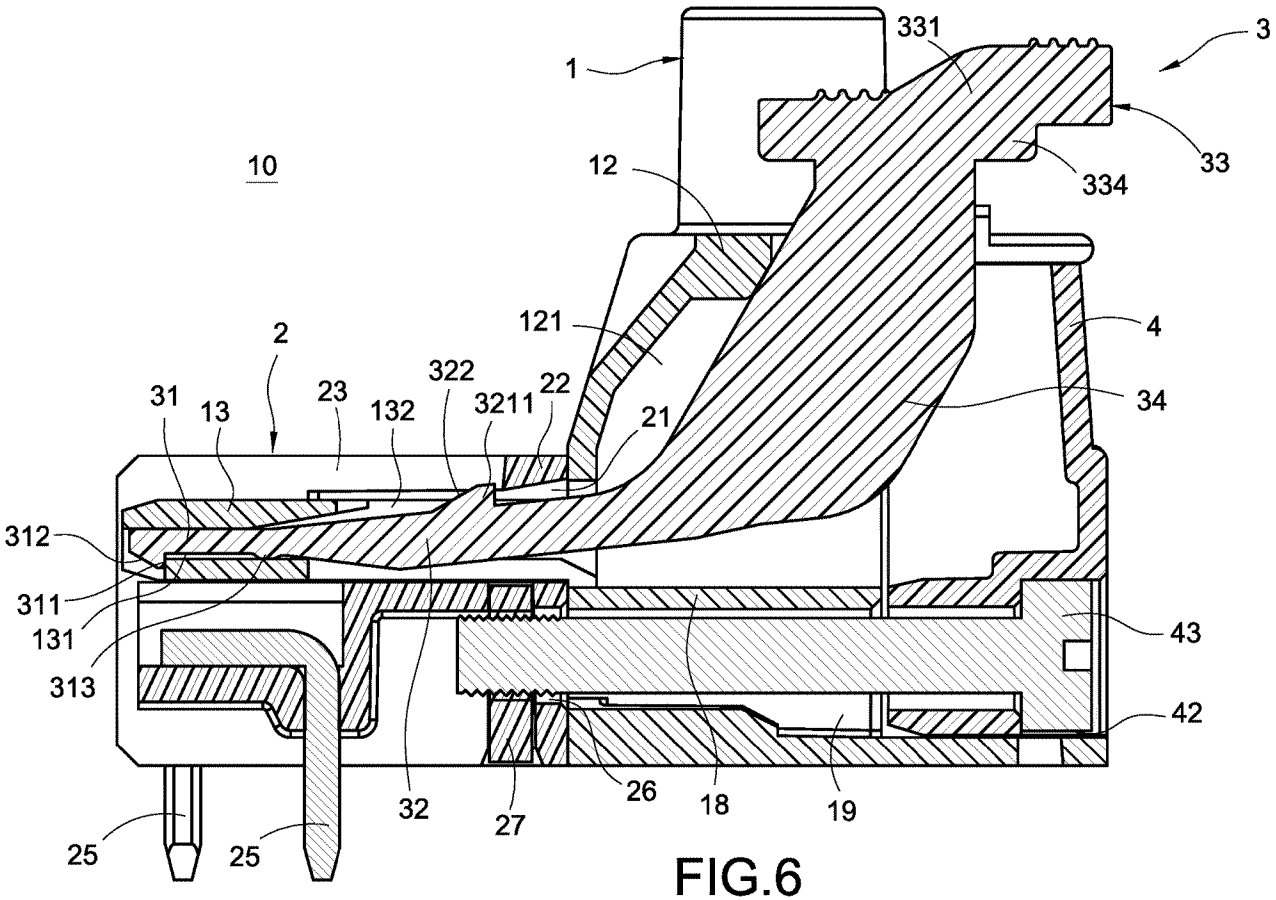
FIG. 6 is a cross-sectional view illustrating the second fastening element is fastened to the screw connection element after the state shown in FIG. 5.

In the embodiment shown in FIGS. 5 and 6, the first connection member 1 further includes a first through hole 19 below the cavity 121 and includes a partition plate 18 separating the cavity 121 from the first through hole 19. The second connection member 2 further includes a second through hole 26 disposed corresponding to the first through hole 19 and includes a screw connection element 27 perpendicularly inserted through the second through hole 26. The cover 4 includes a third through hole 42 disposed corresponding to the first through hole 19. The second fastening element 43 can be inserted through the third through hole 42, the first through hole 19 and the second through hole 26, so that the second fastening element 43 can be fastened to the screw connection element 27 to achieve the secure connection between the first connection member 1 and the second connection member 2. To detach/remove the first connection member 1 from the second connection member 2, first the second fastening element 43 is unfastened from the screw connection element 27, and then the fastening handle 3 is pressed to detach the second protruding block 321 from the fastening portion 22.

Referring to FIGS. 7 and 8, the present invention provides a fastening handle 3, mounted in the terminal block 10 of the previous embodiment. The fastening handle 3 includes an end section 31, an engagement section 32 and a head section 33. The end section 31 has a flat shape. A first protruding block 311 is disposed on one side of the end section 31. The engagement section 32 is extended from one end of the end section 31, and a second protruding block 321 is disposed on one side of the engagement block 32. The second protruding block 321 and the first protruding block 311 are disposed on different sides. The head section 33 is coupled to one end of the engagement section 32 in a manner such that the head section 33 is inclined with respect to the engagement section 32 to form an angle θ therebetween. The first protruding block 311 has an inclined surface 312 at one side, and the second protruding block 321 has an inclined surface 322 at one side.

A bent section 35 is connected between the head section 33 and the engagement section 32, and the angle θ is included between the engagement section 32 and the bent section 35. One end of the head section 32 includes a pressing portion 331 and a rectangular rib 332 disposed between the pressing portion 331 and the bent section 35. In the present embodiment, the fastening handle 3 further includes a connection rib 34 perpendicularly protruding from one side of the fastening handle 3 and includes a fulcrum portion 313 which protrudes from the end section 31, wherein the connection rib 34 is extended from the head section 33, to the bent section 35, then to the engagement section 32, and the fulcrum portion 313 protrudes in a direction the same as a protruding direction of the first protruding block 311. The connection rib 34 has a flat shape and the rectangular rib 332 is hollow inside, so the fastening handle 3 has a reduced weight but a strong structure.

When the end section 31 of the fastening handle 3 is fastened in the terminal block 10, the fulcrum portion 313 serves as a fulcrum pivot point 313, the pressing portion 331 can be pivoted about the fulcrum portion 313. On the other hand, when the pressing portion 331 is not pressed, the fastening handle 3 is restored to its original position/state due to its structure and resilient property.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A terminal block having a fastening handle, comprising:

a first connection member, the first connection member including a plurality of wiring bases arranged in a spaced relationship to each other, a handle platform which adjoins any of the wring bases, a protruding plate which protrudes from the handle platform, and a cavity inside the handle platform, wherein a retaining slot communicating with the cavity is formed inside the protruding plate;

a second connection member, each of the wring bases being correspondingly assembled to the second connection member, the second connection member including a fastening slot into which the protruding plate is plugged and including a fastening portion disposed adjacent to the fastening slot; and a fastening handle, the fastening handle including an end section inserted through the retaining slot and engaged with the protruding plate, an engagement section extended from the end section and received in the cavity, and a head section protruding out of the handle platform, wherein when the head section is moved toward the cavity, the engagement section is released from the fastening portion and is detached from the second connection member.

2. The terminal block having the fastening handle according to claim 1, wherein the fastening handle further includes a first protruding block on the end section, a second protruding block protruding from one side of the engagement section, and a connection rib disposed between the engagement section and head section.

3. The terminal block having the fastening handle according to claim 2, wherein the first protruding block includes an inclined surface disposed corresponding to an inner surface of the protruding plate, and the second protruding block also includes an inclined surface disposed corresponding to an upper end surface of the second connection member.

4. The terminal block having the fastening handle according to claim 2, wherein the first protruding block is engaged with an end edge of the protruding plate, the second protruding plate is slidably engaged with the fastening portion, and the connection rib perpendicularly protrudes from a bottom of the fastening handle.

5. The terminal block having the fastening handle according to claim 2, wherein the end section includes a fulcrum portion abutted against an inner surface of the protruding plate, and the head section includes a pressing portion and a rectangular rib connected under the pressing portion.

6. The terminal block having the fastening handle according to claim 5, wherein a blocker and two limiting blocks partially connected to the blocker at two sides thereof are extended from one end of the rectangular rib away from the end section, and two engagement blocks disposed corresponding to the two limiting blocks protrude from the wring base.

7. The terminal block having the fastening handle according to claim 2, wherein the protruding plate includes a first opening from which the second protruding block is exposed, and the second connection member includes a second opening disposed corresponding to the first opening, so that the second protruding block is inserted through the second opening to be engaged with the fastening portion.

8. The terminal block having the fastening handle according to claim 1, wherein a width of the end section is smaller than a width of the engagement section.

9. The terminal block having the fastening handle according to claim 1, wherein each of the wring bases further includes a plug element, a wire insertion chamber and a wire fastening chamber, the plug element protrudes from the wring base and is parallel to the protruding plate, the wire insertion chamber is formed inside the plug element, and the wire fastening chamber communicates with the wire insertion chamber.

10. The terminal block having the fastening handle according to claim 9, wherein each of the wring bases further includes a wire connection terminal, a conductive case and a first fastening element, the wire connection terminal is inserted into the wire insertion chamber inside the plug element, the conductive case is disposed between the wire insertion chamber and the wire fastening chamber, and the first fastening element is inserted through the wire fastening chamber to fasten the conductive case and a wire, wherein one end of the wire connection terminal is in contact with one side of the conductive case.

11. The terminal block having the fastening handle according to claim 9, wherein the second connection member includes a plurality of insertion slots corresponding to the plug elements respectively and includes a plurality of connecting terminals inserted in the insertion slots respectively.

12. The terminal block having the fastening handle according to claim 1, further comprising a cover covering the wring bases of first connection member, a plurality of the third protruding blocks being arranged in spaced-apart relation to each other at one side of the cover, and each wring base includes a fastening opening corresponding to a respective corresponding one of the third protruding blocks.

13. The terminal block having the fastening handle according to claim 12, wherein the first connection member further includes a first through hole below the cavity and includes a partition plate separating the cavity from the first through hole, the second connection member further includes a second through hole disposed corresponding to the first through hole and includes a screw connection element perpendicularly inserted through the second through hole, and the cover includes a third through hole disposed corresponding to the first through hole.

14. The terminal block having the fastening handle according to claim 13, further comprising a second fastening element, the second fastening element being inserted through the first through hole and the second through hole to be fastened to the screw connection element.

* * * * *